US005305476A

United States Patent [19]

Ohyama et al.

[11] Patent Number: 5,305,476

[45] Date of Patent: Apr. 26, 1994

[54] SHOWER BATHING DEVICE

[75] Inventors: Keiichi Ohyama, Mitaka; Ayami Inaba, Matsudo; Takashi Murata, Yokohama, all of Japan

[73] Assignee: The Nisshin Oil Mills, Ltd., Japan

[21] Appl. No.: 47,628

[22] Filed: Apr. 15, 1993

Related U.S. Application Data

[63] Continuation of Ser. No. 684,558, Apr. 12, 1991, abandoned.

[30] Foreign Application Priority Data

Apr. 13, 1990 [JP] Japan ..... 2-39030

[51] Int. Cl.[5] ..... A47K 3/22

[52] U.S. Cl. ..... 4/605; 4/615; 239/311; 239/318

[58] Field of Search ..... 4/605, 615, 527; 239/310, 311, 315, 318; 604/310

[56] References Cited

U.S. PATENT DOCUMENTS

| | | | |
|---|---|---|---|
| 2,740,670 | 4/1956 | Harder | 299/140.1 |
| 3,231,200 | 1/1966 | Heald | 239/318 |
| 3,285,521 | 11/1966 | Coakley | 239/318 |
| 4,358,056 | 11/1982 | Greenhut et al. | 239/318 |
| 4,623,095 | 11/1986 | Pronk | 239/311 |
| 4,901,765 | 2/1990 | Poe | 239/318 |

FOREIGN PATENT DOCUMENTS

| | | |
|---|---|---|
| 3409626 | 12/1984 | Fed. Rep. of Germany . |
| 2356400 | 6/1978 | France . |
| 2380761 | 9/1978 | France . |
| 60-85749 | 6/1985 | Japan . |
| 61-21753 | 1/1986 | Japan . |
| 61-40153 | 3/1986 | Japan . |
| 61-40154 | 3/1986 | Japan . |
| 445583 | 3/1986 | Japan . |
| 61-155054 | 9/1986 | Japan . |
| 62-42142 | 3/1987 | Japan . |
| 62-42143 | 3/1987 | Japan . |
| 62-144562 | 9/1987 | Japan . |
| 62-194450 | 12/1987 | Japan . |
| 63-121671 | 8/1988 | Japan . |
| 64-48104 | 3/1989 | Japan . |
| 1-223915 | 9/1989 | Japan . |
| 2-112348 | 9/1990 | Japan . |
| 2-132492 | 11/1990 | Japan . |
| 2-134088 | 11/1990 | Japan . |
| 3-29802 | 6/1991 | Japan . |

*Primary Examiner*—Henry J. Recla
*Assistant Examiner*—David J. Walczak
*Attorney, Agent, or Firm*—Bacon & Thomas

[57] ABSTRACT

A shower bathing device comprising a passage through which hot water is passed, a chamber filled with a medical solution to supply the medical solution into the passage, a stream pump for mixing the medical solution in the chamber with hot water passing through the passage, and a screw inserted into a through hole for adjusting the amount of the medical solution supplied to the stream pump, wherein hot water can be showered while including a desired density of medicine therein.

10 Claims, 4 Drawing Sheets

SHOWER BATHING DEVICE

This application is a continuation of application Ser. No. 07/684,558, filed Apr. 12, 1991, now abandoned.

BACKGROUND OF THE INVENTION

1. Field of the Invention

The present invention relates to a shower bathing device capable of making users enjoy bathing hot water showered and also capable of mixing solution for medical or other purposes with hot water showered and freely adjusting the amount of the medical solution mixed.

2. Description of the Related Art

The conventional shower bathing device was intended only to shower hot water. Recently, however, shower bathing device having a section in which a medicine is filled and another section located on the passage of hot water to mix the medicine with hot water passing through the passage has been proposed (Japanese Utility Model Disclosures Sho 61-155054, -40153, -40154, Sho 62-144562, -194450, Japanese Patent Disclosure Hei 1-223915, Japanese Patent Publication Sho 44-5583 and others). This shower bathing device is intended to fill the medical section with a desired medicine and shower through the head of the shower bathing device (or shower head) hot water while mixing hot water with the medicine. The medicine used may be of the solid type and of the solution type.

In the case where the medicine of the solid type is used on the passage of hot water, however, it often happens that the solid medicine is instantly dissolved or not dissolved by hot water passing through the passage. This makes it difficult to adjust the amount of the solid medicine dissolved into hot water. In addition, the solid medicine can be easily dissolved when the temperature of hot water passing through the passage is high but not when it is low. Therefore, users cannot enjoy bathing hot water which is showered through the shower bathing device and in which the medicine is contained at such an amount as desired.

This problem can be avoided when the medicine used is of the solution type. However, the medicine cannot be mixed with hot water only by providing both of the medicine-filled section and the water-medicine mixing section on the passage of hot water. The pressure of hot water passing through the passage is applied to the medicine-filled section to thereby make it impossible to mix the medicine with hot water. It is impossible to mix the medicine with hot water unless the water-medicine mixing section is under pressure-reduced state.

Japanese Utility Model Disclosure Sho 62-194450 discloses a structure wherein medicine is mixed with hot water by a stream pump system. However, it discloses neither system nor means for adjusting the amount of the bath medicine mixed. In short, it discloses only a valve located between a bath medicine tank and the passage of hot water in this case, but this valve cannot change the pressure-reduced state in the water-medicine mixing section, thereby making it impossible to finely adjust the amount of the medicine mixed with hot water.

Japanese Patent Disclosure Hei 1-223915 discloses another structure wherein the flow rate of bath medicine is controlled by an adjusting cock means. This cock means, however, is attached to the same position as the valve is in the above case. Therefore, the flow rate of bath medicine cannot be finely adjusted by the adjusting cock means.

Japanese Patent Publication Sho 44-5583 discloses further structure wherein an opening is formed at the section of the stream pump. However, this opening is intended not to adjust the flow rate of bath medicine but to mix air with hot water passing through the passage. Therefore, the opening has no means for adjusting the extent to which the opening is opened.

The above-described circumstances have forced me, inventor of the present invention, to imagine that an adjustable switch (or changeover valve) is located on the passage of bath medicine to adjust the amount of bath medicine mixed with hot water. However, the pressure-reduced state in the water-medicine mixing section cannot be changed by this switch. Further, the amount of bath medicine mixed cannot be finely adjusted by the switch.

SUMMARY OF THE INVENTION

An object of the present invention is therefore to provide a shower bathing device capable of mixing a bath solution with hot water at such an amount as desired even when the temperature and the flow rate of hot water are changed.

Another object of the present invention is to provide a shower bathing device capable of easily setting a solution therein.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

These and other objects of the present invention can be achieved by a shower bathing device comprising a passage means through which water is passed; a solution chamber filled with a solution to supply the solution into the passage means; and a means for mixing the solution filled in the chamber with water passing through the passage means, said mixing means including a stream pump means arranged on the way of the passage means, a pressure reducing chamber communicated with the stream pump means, a mixing area formed in the pressure reducing chamber and communicated with the solution chamber and means for adjusting the amount of the solution supplied to the mixing area.

According to the shower bathing device of the present invention, the stream pump means is located on the hot water passage means and water is passed through the stream pump means. As the result, the mixing area can be kept reduced in pressure and the solution in the solution chamber can be pulled into water passing through the passage means. The pressure-reduced state in the mixing area changes depending upon both of the temperature and the flow rate of water, but the amount of air mixed into the pressure reducing chamber is adjusted by the adjusting means to thereby adjust the amount of the solution pulled into water. As the result, users can enjoy bathing water in which the solution is contained at such a density as desired.

The shower bathing device of the present invention makes it possible to mix the solution of any of desired medicines such as bath solutions, shampoo, hair rinsing agents, perfumes, abluents, emollient agents, and wound medicines into hot water. In short, the shower bathing device can create such hot water that has any intended effect. Further, whatever type the solution used may be of, the amount of the solution mixed with hot water can be adjusted to thereby achieve more prominent effect which was not seen in the conventional cases. Still further, even if the solution filled in the solution chamber is of the solid or powder type, it can be used in solution to achieve the same effect after it is diffused into water or oil. This makes it possible for the shower bathing device to use almost all of the solution.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE PREFERRED EMBODIMENTS

Some of the shower bathing devices which have been embodied according to the present invention will be described in detail referring to FIGS. 1 through 11 but it should be understood that the present invention is not limited only to these embodiments.

Figure 1:
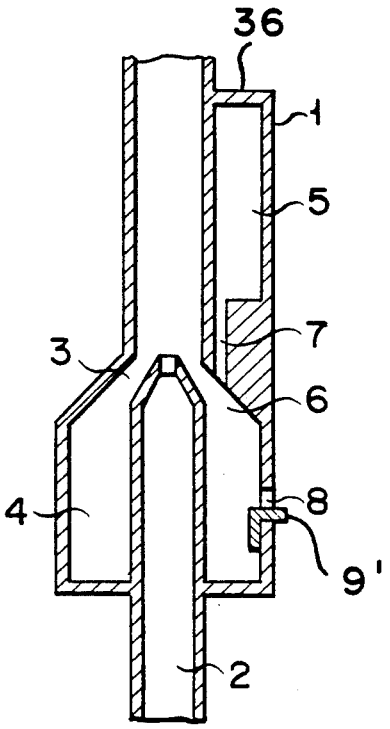
FIG. 1 is a sectional view showing a shower bathing device according to the present invention.
Figure 2:
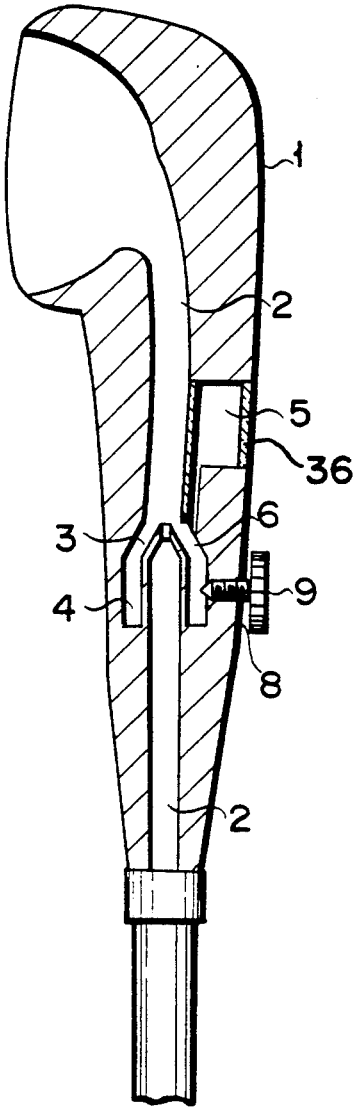
FIG. 2 is a sectional view showing the shower bathing device according to an embodiment of the present invention.

FIG. 1 schematically shows the main portion of a shower bathing device according to the present invention and FIG. 2 shows the whole of the shower bathing device. According to this shower bathing device, a hot water passage 2 is formed in a head 1 of the shower bathing device and a stream pump 3 is arranged enclosing the hot water passage 2. The stream pump 3 is provided with a pressure reducing chamber 4. Another chamber 5 which is filled with medical solution is also formed in the shower head 1 along the hot water passage 2. An area 6 where the medical solution and hot water are mixed is formed in the pressure reducing chamber 4 and this mixing area 6 is communicated with the medical-solution-filled chamber 5 through a medical solution passage 7. The pressure reducing chamber 4 is further provided with a through-hole 8 communicated with the outside, and a air-adjusting members 9 or 9' for adjusting the amount of air allowed to enter into a pressure reducing chamber such as pressure reducing chamber 4, is inserted into the through-hole 8 so as to adjust that open area of the through-hole 8 through which air is allowed to enter into the pressure reducing chamber 4. Numerous suitable air-adjusting members are well-known to those skilled in the art.

When water so hot as to be suitable for shower bathing is passed through the hot water passage 2 in the case of this shower bathing device, air in the pressure reducing chamber 4 is replaced by hot water at once. The pressure of hot water in the pressure reducing chamber 4 is reduced by the action of the stream pump 3 to thereby cause the medical solution in the chamber 5 to be pulled into the pressure reducing chamber 4. It depends upon the temperature and the flow rate of hot water flowing through the hot water passage how the pressure of hot water in the pressure reducing chamber 4 is reduced. The amount of the medical solution pulled into the pressure reducing chamber 4 also depends upon the viscosity of the medical solution.

According to this shower bathing device, the through-hole 8 is adjusted by the air adjusting member 9 or 9', that is, the open area of the through-hole 8 through which the pressure reducing chamber 4 is communicated with air outside is adjusted by the air adjusting member 9. As the result, the pressure reducing extent of hot water in the chamber 4, or the amount of air allowed to enter into the chamber 4, or the amount of the medical solution pulled into the chamber 4 is adjusted. It is preferable in this case that the medical-solution-filled chamber 5 is made of transparent material so as to enable it to be confirmed by eyes how much the medical solution is mixed into hot water in the pressure reducing chamber 4.

Figure 3:
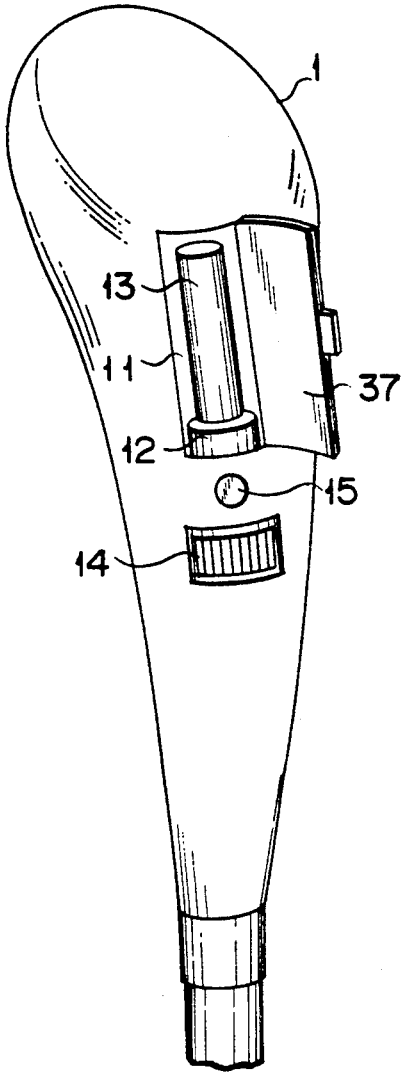
FIG. 3 is a perspective view showing the shower bathing device according to another embodiment of the present invention.

FIG. 3 shows the shower bathing device according to another embodiment of the present invention. A medical solution chamber 11 is formed in the shower head 1 and it can be opened and closed by a swing door member 37. It also includes a disk 12 at the bottom thereof, on which a filler member 13 of the cassette type which is filled with the medical solution is seated. Reference numeral 14 in FIG. 3 denotes an adjusting dial which is arranged, rotatable, enclosing the pressure reducing chamber 4 to adjust the amount of the medical solution pulled into and mixed with hot water in the pressure reducing chamber 4. Another reference numeral 15 represents a cock for opening and closing the medical solution passage 7. The medical solution in the filler member 13 can be prevented from leaking outside if the medical solution passage 7 is closed by the cock 15 when the viscosity of the medical solution is very low and the shower bathing device is left unused.

Figure 4:
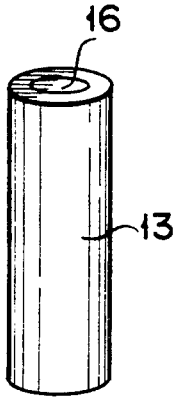
FIG. 4 shows an accessory used by the shower bathing device in FIG. 3.
Figure 5:
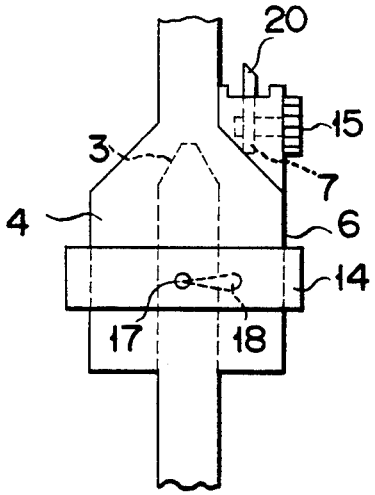
FIG. 5 is a sectional view showing the main portion of the shower bathing device in FIG. 3.

FIGS. 4 and 5 are intended to explain how the shower bathing device in FIG. 3 is operated. FIG. 4 shows the filler member 13 of the cassette type which is filled with the medical solution and which is sealed by an aluminium seal 16. FIG. 5 schematically shows the body portion of the shower head so arranged as to receive the filler member 13, wherein a cylindrical needle 20 is projected from the medical solution passage 7 communicated with the mixing area 6 and the aluminium seal 16 of the filler member 13 is broken by this needle 20 when the filler member 13 is seated on the disk 12 in the filler chamber 11. As the result, the medical solution in the filler member 13 is allowed to flow into the mixing area 6 through the medical solution passage 7. The adjusting dial 14 is provided with a circular air hole 17, and a through-hole 18 which is shaped like a water drop, widening more and more as it comes nearer to the bottom of the water drop, is formed at the wall of the pressure reducing chamber 4. The amount of air allowed to enter into the pressure reducing chamber 4 can be therefore adjusted depending on what part of the water-drop-shaped hole 18 the air hole 17 is superposed, that is, by the open area which is formed by both of the circular air hole 17 and the water-drop-shaped hole 18 and through which the pressure reducing chamber 4 is communicated with air outside.

Although the present invention has been applied to the shower head in the above-described cases, it may be applied to any point on the hot water passage and same merits can also be achieved in this case.

Figure 6:
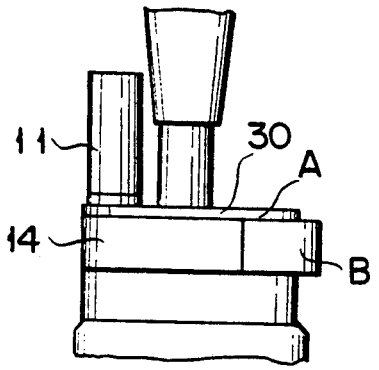
FIG. 6 shows an example of the flow rate adjusting means employed by the present invention.
Figure 7:
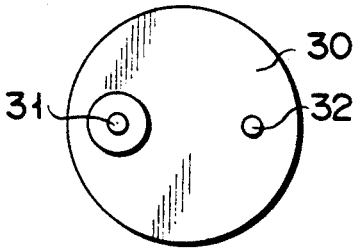
FIG. 7 is a plan intended to explain a section A in FIG. 6.
Figure 8:
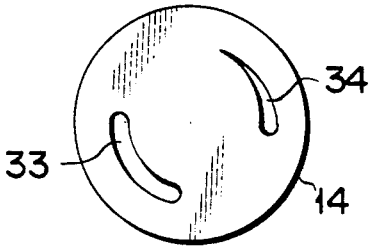
FIG. 8 is a plan intended to explain another section B in FIG. 6.
Figure 9A:
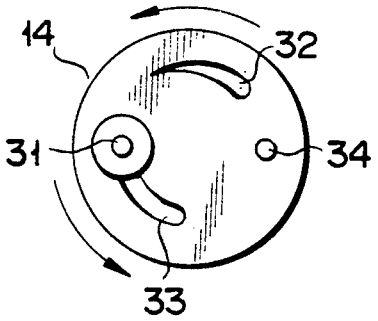
FIGS. 9A through 9C are plans intended to explain how the flow rate adjusting means is operated.
Figure 9B:
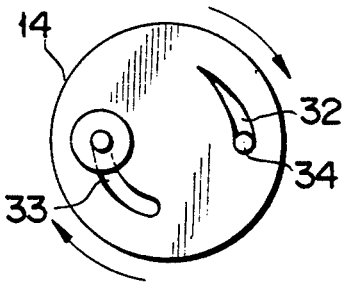
Figure 9C:
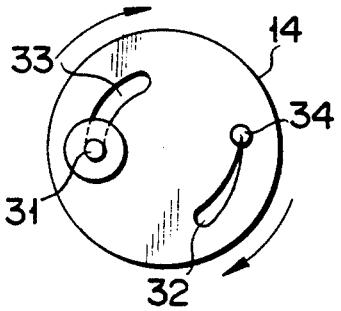

FIG. 6 shows the flow rate adjusting system according to another embodiment of the present invention. FIG. 7 is a plan showing a section A which is included in the flow rate adjusting system shown in FIG. 6. The section A is a disk 30 fixed to the shower head 1 and provided with a circular through-hole 31 through which the medical solution is allowed to enter into the pressure reducing chamber 4 and also provided with a circular through-hole 32 through which air outside is allowed to enter into the chamber 4. FIG. 8 is a plan showing a section B which is included in the flow rate adjusting system shown in FIG. 6. The section B is the adjusting dial 14 provided with an arc slot 33 for adjusting the amount of the medical solution allowed to enter into the pressure reducing chamber 4 and also provided with an arc slot 34 which becomes wider and wider from one end to the other end thereof to adjust the amount of air allowed to enter into the chamber 4. These slots 33 and 34 of the adjusting dial 14 are positioned to correspond to the through-holes 31 and 32 of the disk 30. When the adjusting dial 14 is positioned as shown in FIG. 9A, the through-hole 31 is not superposed on the medical solution adjusting slot 33 to thereby stop the supply of the medical solution into hot water in the pressure reducing chamber 4. In addition, the through-hole 32 is not superposed on the air adjusting slot 34. The amount of air adjusted, therefore, becomes maximum and the force created by the stream pump 3 to pull the medical solution into the pressure reducing chamber 4 becomes minimum. Neither the medical solution nor air outside is allowed to enter into the pressure reducing chamber 4, accordingly. When the adjusting dial 14 is positioned as shown in FIG. 9B, the through-hole 31 is communicated with the medical solution adjusting slot 33 while the through-hole 32 is also communicated with the air adjusting slot 34 through the maximum open sectional area. Therefore, the amount of air is a little adjusted and the solution pulling force created by the stream pump 3 is a little increased, so that a little amount of the medical solution can be mixed with hot water in the pressure reducing chamber 4. When the adjusting dial 14 is positioned as shown in FIG. 9C, the open sectional area of a hole which is formed when both of the through-hole 31 and the medical solution adjusting slot 33 are superposed one upon the other is same as in the case shown in FIG. 9B but the open sectional area of another hole formed when both of the through-hole 32 and the air adjusting slot 34 are superposed one upon the other is made smaller. Therefore, the air adjusting hole is made smaller while leaving the medical solution supply opening open. The medical solution pulling force is thus increased to allow a larger amount of the medical solution to be mixed with hot water in the pressure reducing chamber 4. The amount of the medical solution allowed to enter into the chamber 4 can be finely adjusted by one dial in this manner.

Figure 10:
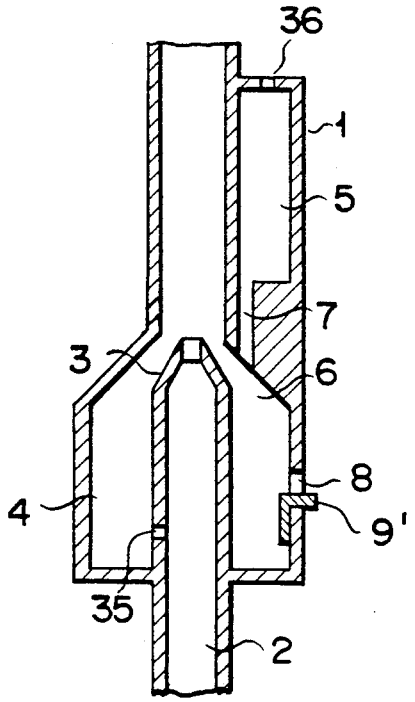
FIGS. 10 and 11 are sectional views showing shower bathing devices according to further embodiments of the present invention.
Figure 11:
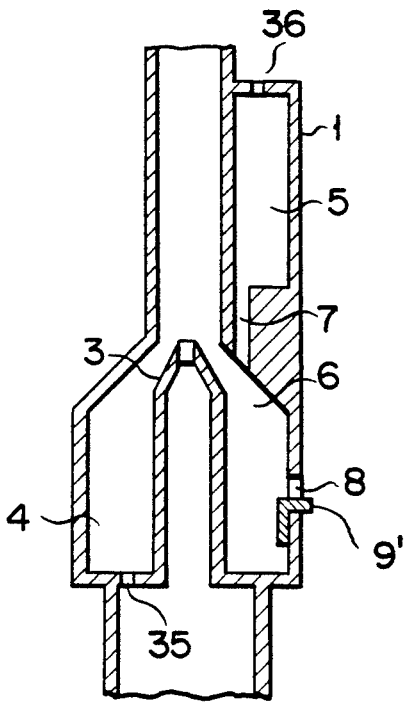

FIGS. 10 and 11 show the shower bathing devices according to further embodiments of the present invention, wherein the function of showering hot water in which the medical solution is mixed is further enhanced. Each of these devices is provided with a small hole 35 through which the hot water passage 2 is communicated with the pressure reducing chamber 4 to allow hot water in the hot water passage to enter into the chamber 4. It is preferable that the size of this small hole 35 is so large as not to extremely lower the pressure reducing action of the stream pump 3. In the case where the shower bathing device has the small hole 35, the medical solution, while being entered into the pressure reducing chamber 4 by the action of the stream pump 3, is violently stirred and mixed with hot water in the pressure reducing chamber 4 by hot water entering into the chamber 4 through the small hole 35, and the hot water thus mixed with the medical solution is then allowed to flow into the hot water passage. In the case where the device has no small hole 35, however, there is a fear that a part of the medical solution is stayed in the pressure reducing chamber 4 to cause hot water showered through the shower bathing device not to have a sufficient amount of the medicine therein, resulting that the medical solution is not showered from the shower head. When the small hole 35 is formed as shown in FIGS. 10 and 11, hot water entering into the pressure reducing chamber 4 through the small hole 35 stirs the medical solution. Thus, hot water showered through the shower head can have a desirable amount of the medicine therein, depending on the extent to which the through-hole 8 is opened or closed.

Further, the chamber 5 which is filled with the medical solution may have a small air hole 36 through which it can be communicated with air outside. The pressure in the chamber 5 can be kept same as atmospheric pressure by this small air hole 36 to thereby enable the medical solution to be mixed with hot water in the pressure reducing chamber 4 under steady state. Small air holes are also shown in FIGS. 1 and 2 for the same purpose.

Although both of the small holes 35 and 36 have been provided in the above cases, it is not necessarily needed that the shower bathing device has both of them.

As will be immediately apparent to those skilled in the art, hole 36 can function both as an air hole through which chamber 5 can communicate with the outside, and also as the opening for injecting medical solution into the chamber. If the chamber is formed of a transparent material, as described above, the amount injected through hole 36 can clearly be seen from the outside and the amount of solution injected can easily be adjusted.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalents.

What is claimed is:

1. A shower bathing device having a shower head, said shower head comprising:

a passage means through which water is passed;

a solution chamber and solution supply means for supplying a medical solution into the passage means; and mixing means for mixing the solution with water passing through the passage means, said mixing means including stream pump means arranged in the passage means, a pressure reducing chamber having a through hole, and directly communicating with the stream pump means and with air outside the shower bathing device via the through hole, a mixing area formed in the pressure reducing chamber and communicating with the solution supply means to receive the medical solution, and means for adjusting the amount of the solution supplied to the mixing area by adjusting the amount of air entering from outside of the shower bathing device into the pressure reducing chamber, wherein said mixing area is situated between the adjusting means and the solution supply means and wherein the solution thereby enters the mixing area from the supply means at a location different from a location at which said air enters the mixing area.

2. The shower bathing device according to claim 1, wherein said solution chamber is made by transparent material.

3. The shower bathing device according to claim 1, wherein said device further comprises a solution-filled member to be detachably attached in said solution chamber, said member having a seal at one end thereof, said solution chamber including a disk on which the member is seated, and a means for breaking the seal when the member is seated, said braking means is projected from the disk and communicated with the mixing area to supply the solution in the member to the mixing area.

4. The shower bathing device according to claim 1, wherein said adjusting means comprises means for adjusting the extent to which the pressure reducing chamber communicates with the air outside the shower bathing device.

5. The shower bathing device according to claim 1, wherein said adjusting means comprises a through-hole formed at the wall of the pressure reducing chamber, a dial member arranged rotatable around the pressure reducing chamber and a through-hole formed at the dial member and wherein said through-holes are positioned to become superposed one upon the other as the dial member is rotated and both of them are shaped so different from the other as to change the open sectional area of a hole formed when they are superposed one upon the other as the dial member is rotated.

6. The shower bathing device according to claim 5, wherein one of the through-holes is shaped circular and the other of them is shaped like a water drop, widening more and more from one end to the other end thereof.

7. The shower bathing device according to claim 1, wherein said adjusting means comprises a plate member interposed between the chamber and the mixing area and provided with a solution adjusting through-hole communicated with the chamber and an air through-hole opened outside, and a dial member arranged rotatable round the pressure reducing chamber and provided with a solution adjusting through-hole and an air through-hole and wherein the through-holes of the chamber and the dial member are positioned to become superposed one upon the other as the dial member is rotated and the through-holes of the chamber and the dial member are positioned to become communicated and closed as the dial member is rotated while both of them are shaped so different from the other as to change the open sectional area of a hole formed when they are superposed one upon the other as the dial member is rotated.

8. The shower bathing device according to claim 7, wherein one of the through-holes is shaped circular and the other of them is shaped like an arc having a substantially certain width.

9. The shower bathing device according to claim 7, wherein one of the through-holes is shaped circular and the other of them is shaped like an arc, widening more and more from one end to the other end thereof.

10. The shower bathing device according to claim 1, further comprising a means for communicating the passage means with the pressure reducing chamber.

* * * * *